US005885148A

United States Patent [19]

Vargas et al.

[11] Patent Number: 5,885,148

[45] Date of Patent: Mar. 23, 1999

[54] FLEXIBLE FINISHING GLOVE

[76] Inventors: Richard Dean Vargas, 418 Marion Ct., Alameda, Calif. 94501; Gerald J. Wilson, 30721 Lake Front Dr., Agoura Hills, Calif. 91301

[21] Appl. No.: 937,212

[22] Filed: Sep. 17, 1997

[51] Int. Cl.[6] ..... B24D 15/04

[52] U.S. Cl. ..... 451/523; 451/538

[58] Field of Search ..... 451/523, 538, 451/539; 15/227; 2/158, 160

[56] References Cited

U.S. PATENT DOCUMENTS

| | | | |
|---|---|---|---|
| 782,583 | 2/1905 | Seebacher | 2/158 |
| 1,782,577 | 11/1930 | Maris . | |
| 2,485,295 | 10/1949 | Larson | 206/56 |
| 3,151,333 | 10/1964 | Scholz | 451/523 |
| 3,540,160 | 11/1970 | DeRose et al. | 51/170 |
| 3,643,386 | 2/1972 | Grzyll | 51/391 |
| 3,748,792 | 7/1973 | Lamb | 451/523 |
| 3,789,555 | 2/1974 | Means | 51/391 |
| 3,885,249 | 5/1975 | DeBrabander | 2/161 |
| 4,038,787 | 8/1977 | Bianchi | 51/391 |
| 4,107,840 | 8/1978 | Kupperman et al. | 30/172 |
| 4,593,427 | 6/1986 | Ortolivo | 451/523 |
| 5,134,809 | 8/1992 | Morton et al. | 51/391 |

FOREIGN PATENT DOCUMENTS

| | | | |
|---|---|---|---|
| 1456770 | 11/1976 | United Kingdom | 2/158 |
| 2078091 | 1/1982 | United Kingdom | 2/158 |
| 2260889 | 5/1993 | United Kingdom | 2/160 |

*Primary Examiner*—Robert A. Bose
*Attorney, Agent, or Firm*—James Yuanxin Li

[57] ABSTRACT

A novel reusable flexible hand-held, mitten-shaped glove to which one or more layers of abrasive, cleaning, or polishing material may be attached to the glove's face by means of a suitable non-permanent, pressure-sensitive, and moisture-resistant adhesive that has been applied to the back of the material. The abrasive, cleaning, or polishing material may be peeled off as needed either to expose fresh material or to attach new material to the face of the glove.

2 Claims, 3 Drawing Sheets

FLEXIBLE FINISHING GLOVE

FIELD OF INVENTION

The invention relates to a reusable flexible hand-held glove to which a sheet of abrasive, cleaning, or polishing material may be attached to its face by means of a suitable adhesive.

BACKGROUND OF THE INVENTION

The hand-held non-powered use of sandpaper to smooth a surface or use of non-abrasive materials to clean and polish surfaces have had numerous inherent difficulties.

Currently, one method has been to affix the sandpaper or other material to a device such as a sanding block. The block, as the name implies, provides a flat face with which to make contact with a surface to be finished. However, such devices work best only on finishing surfaces that are equally flat. If the surface is curved, the use of a sanding block-type device with a flat face will cause uneven contact with that surface. If an abrasive material is being used, the device's flat face may actually damage the object being worked upon.

Alternatively, the user may simply hold the sandpaper or non-abrasive material by hand to make contact with the surface to be finished. The advantages of this method are that it does not require the purchase of any special devices and that the hand-held finishing material can easily be conformed to the shape of any curved surfaces. Unfortunately, this method is not practical for finishing larger surfaces because sustained use may cause hand cramping or even repetitive hand stress injury. Further, unless a work glove is worn, moving the sandpaper or other material along a surface exposes the hand to physical injury or trauma from the work object. This method, while inexpensive, also has the disadvantage of not being able to apply the sandpaper or other material with even pressure upon the surface.

SUMMARY OF THE INVENTION

The present invention provides a unique flexible finishing glove that is inexpensive, is reusable, and protects the hand while in use. The glove offers the advantages of the currently-available alternative methods without the disadvantages.

The present invention provides a flat, mitten-shaped, flexible glove to which two elastic bands are attached on the back side. Four fingers of one hand slip under the horizontal elastic band while the second elastic band holds the thumb in place. The gloves may come in left handed or right handed versions. The glove backing material is constructed of a dense foam, flexible polymer, treated cardboard, or other suitable alternative.

A suitable non-permanent, pressure-sensitive, and moisture-resistant adhesive has been applied to the back of the sheet of finishing material (i.e., the sandpaper or non-abrasive material) in order to affix the sheet to the face of the glove. The sandpaper or other material may be removed at regular intervals as necessary and replaced by the same or by a different grade of sandpaper. Thus, the glove is reusable. Alternatively, the sandpaper with the suitable adhesive backing may comprise multiple layers. As the top sheet of sandpaper is used up, that sheet may be peeled off to expose new sandpaper.

The flexible finishing glove permits the sandpaper or non-abrasive material to conform to the shape of the surface to be finished. Whereas, in the past, two or more hand-held finishing devices would need to be purchased to accommodate the shapes of differing work surfaces, the present invention is equally adaptable and suitable for use on flat and curved surfaces. The glove may be utilized to sand and finish various materials, including wood, metal, sheetrock, and plastic. The invention's incorporation of suitable adhesives and nonabsorbent polymer or foam materials also permits the glove to be utilized in situations where liquid or moisture may be present as well as in dry locations.

The glove is designed so that the thumb may be used independently to finish more detailed and confined surfaces. Use of the glove has the further advantage of distributing the pressures being exerted upon the work surface by the glove's face so that there will not be areas of non-uniform contact by the sandpaper or other material.

The materials used in the glove are designed so as to make the invention accessible to the non-professional user. Thus, a person who may not want to purchase specialized tools and devices for a weekend project will be more apt to use the present invention. The glove offers relatively inexpensive hand protection from fatigue, physical injury from work materials, and long-term repetitive stress-type injuries that could afflict a user who might otherwise take few or no safety precautions.

For the general or professional user, the glove's slimline design permits its use in confined or precarious locations where a sanding block or powered sanding device would not be feasible. While the professional user may not generally include a sanding device as part of the day-to-day tools carried on the job, the invention's flat and lightweight design permits a worker to add the glove to his or her tool belt for use in impromptu sanding or finishing without also adding any noticeable bulk or weight to the tool belt.

A prior invention relating to finishing devices merely offers a variation of the sanding or finishing block device. U.S. Pat. No. 3,540,160 granted to De Rose, et al., depicts in its most relevant embodiment a rectangular flat pad with a strap through which four fingers of a worker's hand are used to hold the pad in place. The pad is semi-rigid and cannot conform to curved work surfaces. In that embodiment, the De Rose invention does not offer much advantage over a standard sanding or finishing block. The De Rose invention further makes no provision for the placement of the thumb, thus exposing the thumb to injury from work material. On the other hand, the present invention not only protects the thumb but also utilizes the anatomical benefits of the *Homo sapiens*' opposable thumb feature by allowing the thumb to make independent contact with the surface to be finished. U.S. Pat. No. 3,885,249 granted to De Brabander and U.S. Pat. No. 5,134,809 granted to Morton, et al., both also fail to permit the thumb to work independently of the rest of the glove.

Other prior inventions also lack the combination of advantages available in the present invention. For example, U.S. Pat. No. 3,151,333 granted to Scholz; U.S. Pat. No. 3,643,386 granted to Grzyll; U.S. Pat. No. 3,748,792 granted to Lamb; U.S. Pat. No. 3,789,555 granted to Means; U.S. Pat. No. 4,038,787 granted to Bianchi; U.S. Pat. No. 4,107,840 granted to Kupperman, et al.; U.S. Pat. No. 4,593,427 granted to Ortolivo; and the Morton invention are all variations of abrasive surfaces on gloves or mittens. However, these enclosed glove-based systems contain numerous disadvantages.

Where the fingers move independently, the work surface can be damaged because of uneven pressure. The present invention solves this problem by the use of the mitten to distribute the pressure evenly. The present invention also utilizes removable adhesive or finishing material, allowing the glove to be reused indefinitely. However, a key advantage to the present invention over the prior art is precisely that the invention is not a standard enclosed glove or mitten. As a result, there is no build up of debris within the glove, which might otherwise cause injury to a worker's hand if there were sharp pieces of metal or slivers of wood debris inside that have accumulated over time.

That the present invention is not a standard glove also encourages its use. A worker may not wish to carry two pairs of gloves with him or her (e.g., standard sanding gloves in addition to leather work gloves) because each pair is bulky. Carrying two similar-looking pairs of gloves that perform different functions may result in confusion; a worker may find that he or she has unintentionally brought the wrong glove to a job. However, the flat, lightweight shape of the present invention causes no confusion with standard work gloves and will be more likely to be used because of the ease of carrying it around on a job site.

It should also be noted that much of the prior art describes gloves that are constructed of materials such as rubber, paper, cloth, or cotton. The present non-enclosed nature of the present invention precludes the build up of body heat that would result from the more standard glove designs. The flat, flexible material of the present invention also acts as a shield to protect a worker's hand. While the glove materials used in the prior art are susceptible to penetration by slivers of metal or wood, the present invention utilizes a dense material that deflects sharp materials that might cause injury.

OBJECT OF THE INVENTION

Therefore, it is the primary object of the present invention to provide a novel reusable flexible hand-held glove to which one or more sheets of abrasive, cleaning, or polishing material may be attached to its face by means of a suitable adhesive.

Other objects, features, and advantages of the invention will become apparent to those skilled in the art from a consideration of the detailed description and the accompanying drawings.

DRAWING FIGURES

The present invention will now be described by way of example with reference to the accompanying drawings in which.

DETAILED DESCRIPTION

Figure 1:
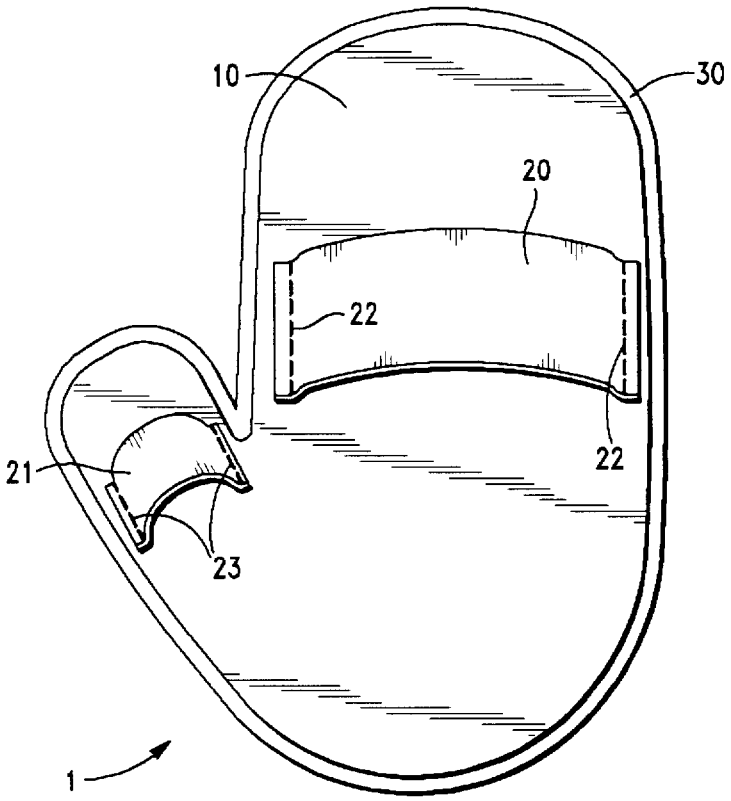
FIG. 1 is a rear view of a glove having finger and thumb straps.
Figure 2:
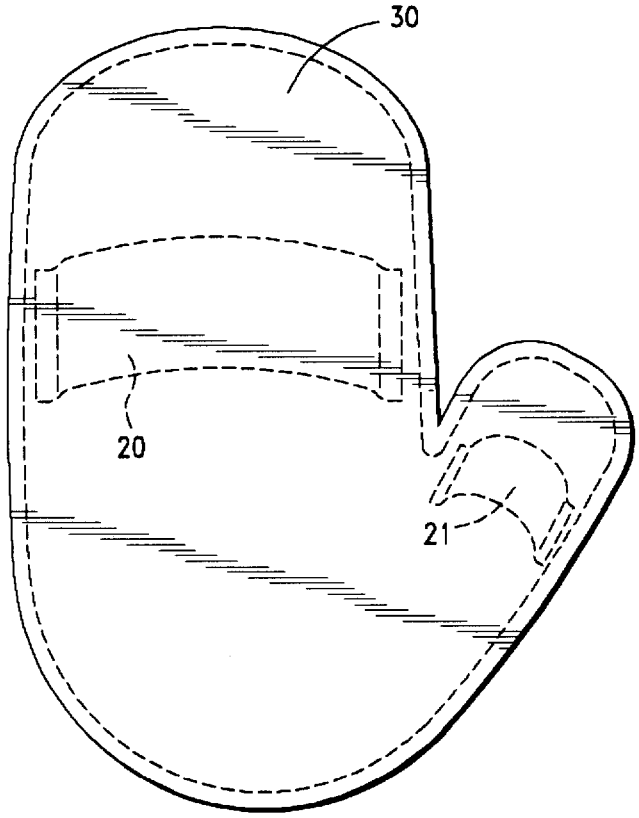
FIG. 2 is a front view of the glove of FIG. 1 having a sheet of sandpaper affixed to the face of the glove.
Figure 3:
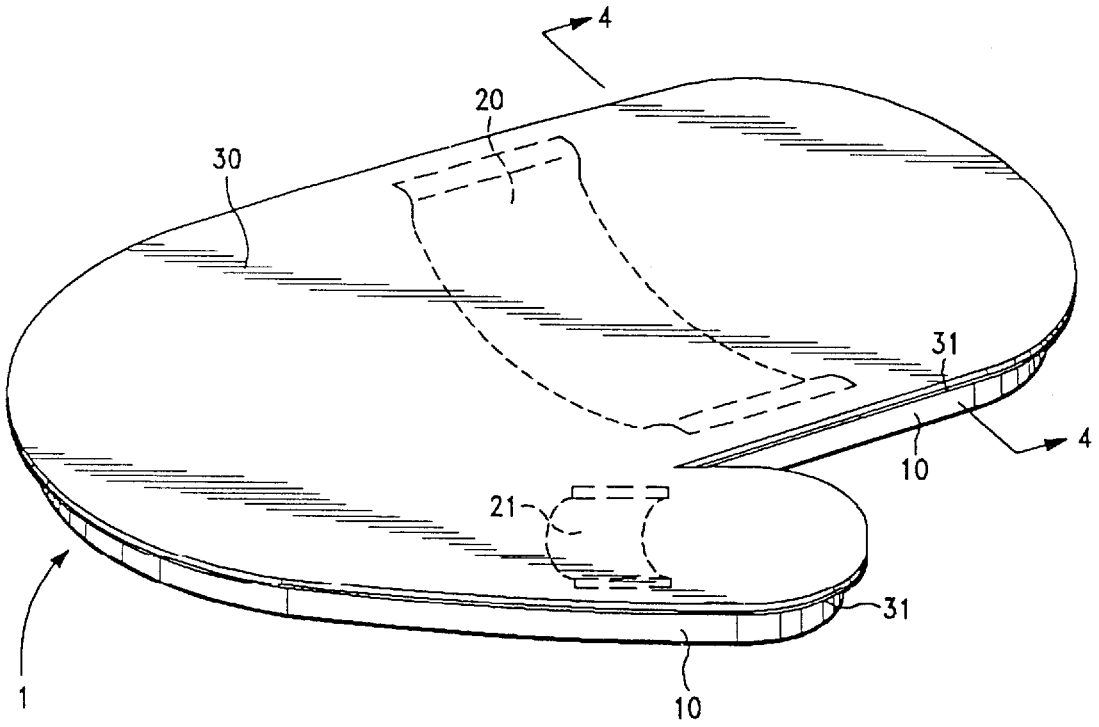
FIG. 3 is a perspective view of the glove of FIG. 1 according to the first embodiment of the present invention.

Referring to FIGS. 1 through 4 for the first embodiment, a flexible finishing glove (1) according to the present invention includes a mitten-shaped flexible backing (10) for the glove to which similarly shaped sandpaper (30) is adhered to the face of such glove. The backing may be composed of any suitable lightweight material such as dense foam, flexible polymer, treated cardboard, or the like. To the back of the glove is attached a horizontal finger strap (20) and an angled thumb strap (21). The straps are elastic so as to accommodate different sized hands and are attached to the flexible backing (10) by means of stitching (22 and 23). Alternatively, other suitable means of attachment such as riveting, gluing, thermobonding, or the like may be used.

The sandpaper (30) may be somewhat larger than the face of the flexible backing (10), thus allowing the edge of the flexible backing (10) to be used to press upon the protruding sandpaper for areas where more precise sanding is required. A typical embodiment may have the sandpaper (30) extending approximately 3/16" beyond each edge of the flexible backing (10).

Figure 4:
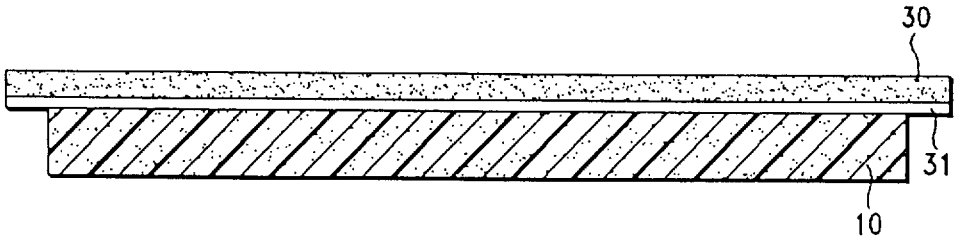
FIG. 4 is a cross-section taken along lines 4—4 of FIG. 3 showing the sheet of sandpaper with adhesive affixing said sheet to the flexible backing for the glove.

As shown in FIG. 4, a suitable non-permanent, pressure-sensitive, and moisture-resistant adhesive (31) has been applied to the back of the sheet of sandpaper (30) in order to affix the sheet to the face of the flexible backing (10). The adhesive used permits the removal of the sandpaper (30) without leaving any adhesive residue upon the flexible backing (10).

Figure 5:
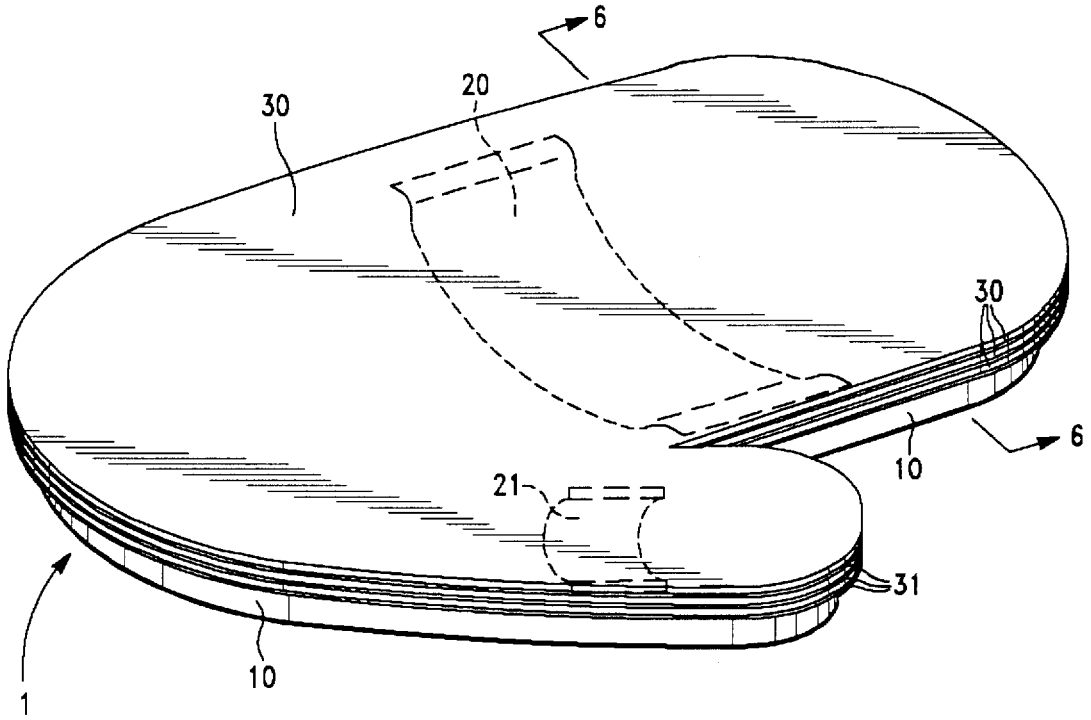
FIG. 5 is a perspective view of a glove according to the second embodiment of the present invention.
Figure 6:
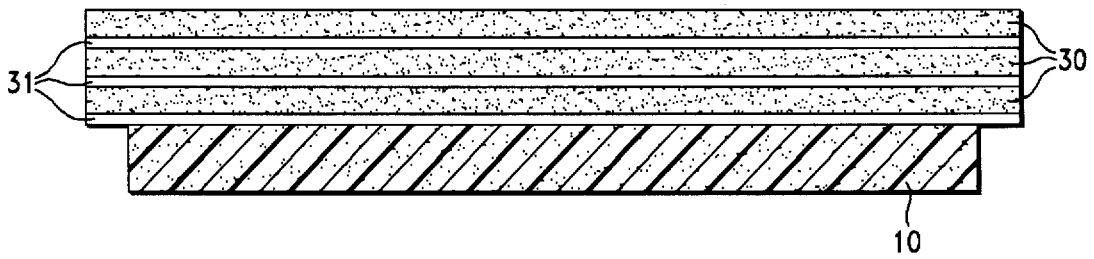
FIG. 6 is a cross-section taken along lines 5—5 of FIG. 5 showing multiple layers of sandpaper with affixing said sheets to the flexible backing for the glove.

A second embodiment of a flexible finishing glove (1) is described while referring concurrently to FIGS. 5 to 6 of the drawings. In this embodiment, the flexible finishing glove as previously described now includes multilayered sheets of sandpaper (30) rather than a single sheet. A suitable non-permanent, pressure-sensitive, and moisture-resistant adhesive (31) has been applied to the back of each sheet of sandpaper (30) in order to affix each sheet either to the sandpaper sheet below it or to the face of the flexible backing. Thus, as the top sheet of the multiple layers of sandpaper (30) is used up, that top layer may be peeled off to expose new sandpaper. The adhesive used permits the removal of the sheet of sandpaper (30) without leaving any adhesive residue either upon the sandpaper sheet below it or upon the flexible backing (10).

A third embodiment of a flexible finishing glove (1) is described while referring concurrently to FIGS. 5 to 6 of the drawings. In this embodiment, the flexible finishing glove as previously described now utilizes non-abrasive material in place of sheets of sandpaper (30). The non-abrasive material may, for example, consist of a similarly mitten-shaped wool buffing pad, chemically impregnated polishing cloth, or the like with adhesive backing (31).

What is claimed is:

1. A hand-held finishing device comprising:

(a) a flexible lightweight mitten-shaped backing whereby the manipulation of the fingers and thumbs of the user permits said device to conform to the shape of the work surface;

(b) two elastic straps affixed to the rear of said backing, said straps consisting of one horizontal strap of sufficient width to cover the proximal phalanx bones of the fingers of the hand and of one angled strap of sufficient width to cover the proximal phalanx bone of the thumb of said hand; and (c) a sheet of finishing material having marginal edges extending a uniform and predetermined length beyond the edges of said backing and having a suitable non-permanent, pressure-sensitive, and moisture-resistant adhesive on its reverse side serving to adhere said sheet to said backing.

2. The invention according to claim 1, further including a plurality of layers of sheets of finishing material, said material each having a suitable non-permanent, pressure-sensitive, and moisture-resistant adhesive on its reverse side serving to adhere each sheet to the surface below it.

* * * * *